US010013925B2

(12) United States Patent
Gan et al.

(10) Patent No.: US 10,013,925 B2
(45) Date of Patent: Jul. 3, 2018

(54) DISPLAY DEVICE, LIGHT CONVERTING DEVICE AND DISPLAY SYSTEM

(71) Applicants: BOE Technology Group Co., Ltd., Beijing (CN); Hefei Xinsheng Optoelectronics Technology Co., Ltd., Hefei (CN)

(72) Inventors: Quan Gan, Beijing (CN); Lei Guo, Beijing (CN); Yongcan Wang, Beijing (CN); Yong Jun Yoon, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 0 days.

(21) Appl. No.: 15/189,701

(22) Filed: Jun. 22, 2016

(65) Prior Publication Data

US 2017/0094757 A1 Mar. 30, 2017

(30) Foreign Application Priority Data

Sep. 28, 2015 (CN) ..... 2015 1 0629710

(51) Int. Cl.
*G09G 3/34* (2006.01)

(52) U.S. Cl.
CPC ... *G09G 3/3406* (2013.01); *G09G 2320/0626* (2013.01); *G09G 2358/00* (2013.01)

(58) Field of Classification Search
CPC ..... H05B 33/0872; H05B 33/0803; H05B 33/0854; H05B 33/0857; G01J 1/0488; G01J 2001/4252; G01J 3/506
USPC ..... 348/58, E13.075; 353/31, 84; 359/40, 359/51, 41; 345/5, 6, 7, 8, 9, 10, 11, 38, 345/39–61, 152–158
See application file for complete search history.

(56) References Cited

U.S. PATENT DOCUMENTS 6,177,965 B1 * 1/2001 Takahara ..... H04N 9/3129 348/E5.141
6,370,275 B1 * 4/2002 Benoit ..... G09G 3/2022 345/60

(Continued)

FOREIGN PATENT DOCUMENTS

CN 101409061 A 4/2009
CN 201600532 U 10/2010

(Continued)

OTHER PUBLICATIONS

Apr. 5, 2017—(CN) First Office Action Appn 201510629710.5 with English Tran.

(Continued)

*Primary Examiner* — Douglas W Owens
*Assistant Examiner* — Wei Chan
(74) *Attorney, Agent, or Firm* — Banner & Witcoff, Ltd.

(57) ABSTRACT

A display device, a light converting device and a display system are provided. The display device includes a light-emitting module configured to emit at least two non-visible lights, non-visible lights of different types having different wavelengths; and a control module configured to control the light-emitting module to alternately emit the at least two non-visible lights at a wavelength adjusted timing, and to send a synchronous signal to a light converting device, the synchronous signal being configured to reflect the wavelength adjusted timing.

16 Claims, 5 Drawing Sheets

(56) References Cited

U.S. PATENT DOCUMENTS

| | | | | |
|---|---|---|---|---|
| 9,134,593 | B1 * | 9/2015 | Worley, III | G03B 21/147 |
| 2002/0054231 | A1 * | 5/2002 | Masuyuki | G03F 7/70041 348/362 |
| 2006/0151449 | A1 * | 7/2006 | Warner, Jr. | B23K 26/0066 219/121.65 |
| 2008/0174742 | A1 | 7/2008 | Ito | |
| 2009/0097859 | A1 | 4/2009 | Tsai et al. | |
| 2010/0253769 | A1 * | 10/2010 | Coppeta | G02B 27/1026 348/58 |
| 2013/0258203 | A1 * | 10/2013 | Atkins | G09G 5/02 348/708 |
| 2014/0055322 | A1 | 2/2014 | Cai et al. | |
| 2014/0191933 | A1 * | 7/2014 | Fan | G02F 1/133 345/89 |
| 2015/0253653 | A1 * | 9/2015 | Fujita | H04N 9/3111 353/31 |
| 2016/0334652 | A1 * | 11/2016 | Sakuma | H01S 3/2391 |
| 2017/0048501 | A1 * | 2/2017 | Li | G02B 27/10 |

FOREIGN PATENT DOCUMENTS

| | | | |
|---|---|---|---|
| CN | 103353689 | A | 10/2013 |
| CN | 103631018 | A | 3/2014 |
| CN | 103984185 | A | 8/2014 |
| WO | 2012070273 | A1 | 5/2012 |

OTHER PUBLICATIONS

Dec. 15, 2017—(CN) Second Office Action Appn 201510629710.5 with English Tran.

* cited by examiner

DISPLAY DEVICE, LIGHT CONVERTING DEVICE AND DISPLAY SYSTEM

This application claims priority to and the benefit of Chinese Patent Application No. 201510629710.5 filed on Sep. 28, 2015, which application is incorporated herein in its entirety.

TECHNICAL FILED

Embodiments of the present disclosure relates to a display device, a light converting device and a display system.

BACKGROUND

Along with the continual advancement of display technology, portable display devices spring up unceasingly. At present, there are many kinds of portable display devices on the market, and users can use display devices at any time and in any place. However, when a display device is used in the public occasion, it is very easy for other people to get a peep of the information.

SUMMARY

Embodiments of the present disclosure provide a display device, a light converting device and a display system.

According to at least one embodiment of the present disclosure, a display device is provided. The display device includes a light-emitting module configured to emit at least two non-visible lights, non-visible lights of different types among which have different wavelengths; and a control module configured to control the light-emitting module to alternately emit the at least two non-visible lights at a wavelength adjusted timing, and to send a synchronous signal to a light converting device, the synchronous signal is used for reflecting the wavelength adjusted timing.

In an example, the light-emitting module includes at least two non-visible light sources, non-visible lights that can be emitted from the non-visible light sources of different types having different wavelengths. The control module is configured to control the at least two non-visible light sources to emit light alternately at a wavelength adjusted timing.

In an example, the light-emitting module includes a first non-visible light source and a second non-visible light source; and the control module is configured to control the first non-visible light source and the second non-visible light source to emit two non-visible lights alternately at a wavelength adjusted timing.

In an example, the first non-visible light source is an infrared light source, and the second non-visible light source is an ultraviolet light source.

In an example, the light-emitting module includes a visible light source; and a wavelength converting unit configured to convert a visible light emitted from the visible light source into a non-visible light. The control module is configured to control the wavelength converting unit to alternately convert the visible light into at least two non-visible lights at a wavelength adjusted timing.

In an example, the wavelength converting unit is a non-linear crystal or a semiconductor optical amplifier.

According to at least one embodiment of the present disclosure, a light converting device is provided. The light converting device includes: a first receiving module configured to receive at least two non-visible lights emitted alternately by a display device; a second receiving module configured to receive a synchronous signal sent by the display device, the synchronous signal being configured to reflect a wavelength adjusted timing of the display device; and a control module configured to synchronously convert, based on the synchronous signal, the at least two non-visible lights into visible lights at the wavelength adjusted timing and to output the visible lights.

In an example, the control module includes a first control unit configured to transmit, based on the synchronous signal, a non-visible light received at the current time in the wavelength adjusted timing to a wavelength converting unit by an input optical path corresponding to the non-visible light, non-visible lights of different types corresponding to different input optical paths; and at least two wavelength converting units, each of which is configured to convert one non-visible light into a visible light.

In an example, the control module further includes a second control unit, configured to output, based on the synchronous signal, the visible light emitted from the wavelength converting unit by an output optical path corresponding to the visible light, visible lights obtained by converting non-visible lights of different types corresponding to different output optical paths.

In an example, the first control unit includes a first selecting sub-unit configured to transmit, based on the synchronous signal, a non-visible light received at the current time in the wavelength adjusted timing to a first optical path altering sub-unit, the first optical path altering sub-unit being configured to receive a non-visible light emitted from the first selecting sub-unit and to transmit the non-visible light to a wavelength converting unit.

In an example, each of the first selecting sub-unit and the first optical path altering sub-unit is a mirror.

In an example, the second control unit includes a second optical path altering sub-unit configured to output a visible light emitted from the wavelength converting unit to a second selecting sub-unit; and a second selecting sub-unit configured to output, based on the synchronous signal, a visible light emitted from the second optical path altering sub-unit.

In an example, each of the second selecting sub-unit and the second optical path altering sub-unit is a mirror.

In an example, the light converting device is a pair of glasses.

According to an embodiment of the present disclosure, a display system a light is provided. The display system includes a display device and a light converting device. The display device includes: a light-emitting module configured to emit at least two non-visible lights, non-visible lights of different types having different wavelengths; and a control module configured to control the light-emitting module to alternately emit the at least two non-visible lights at a wavelength adjusted timing, and to send a synchronous signal to the light converting device, the synchronous signal being configured to reflect the wavelength adjusted timing. The light converting device includes a first receiving module configured to receive at least two non-visible lights emitted alternately by a display device; a second receiving module configured to receive a synchronous signal sent by the display device, the synchronous signal being configured to reflect a wavelength adjusted timing of the display device; and a control module configured to synchronously convert, based on the synchronous signal, the at least two non-visible lights into visible lights at the wavelength adjusted timing, and to output the visible lights.

In an example, the light-emitting module includes at least two non-visible light sources, and non-visible lights that can be emitted from the non-visible light sources of different types have different wavelengths. The control module is configured to control the at least two non-visible light sources to emit light alternately at a wavelength adjusted timing.

In an example, the light-emitting module includes a first non-visible light source and a second non-visible light source. The control module is configured to control the first non-visible light source and the second non-visible light source to emit two non-visible lights alternately at a wavelength adjusted timing.

In an example, the light-emitting module includes: a visible light source; a wavelength converting unit configured to convert a visible light emitted from the visible light source into a non-visible light. The control module is configured to control the wavelength converting unit to alternately convert the visible light into at least two non-visible lights at a wavelength adjusted timing.

In an example, the control module includes: a first control unit configured to transmit, based on the synchronous signal, a non-visible light received at the current time in the wavelength adjusted timing to a wavelength converting unit by an input optical path corresponding to the non-visible light, non-visible lights of different types corresponding to different input optical paths; and at least two wavelength converting units, each of which being configured to convert one non-visible light into a visible light.

In an example, the control module further includes a second control unit configured to output, based on the synchronous signal, the visible light emitted from the wavelength converting unit by an output optical path corresponding to the visible light, visible lights that is obtained by converting non-visible lights of different types corresponding to different output optical paths.

BRIEF DESCRIPTION OF DRAWINGS

Embodiments of the present disclosure will be described in more detail as below in conjunction with the accompanying drawings to enable those skilled in the art to understand the present disclosure more clearly, in which.

DETAILED DESCRIPTION

Technical solutions according to the embodiments of the present disclosure will be described clearly and thoroughly as below in conjunction with the accompanying drawings of embodiments of the present disclosure. It is apparent that the described embodiments are only a part of but not all of exemplary embodiments of the present disclosure. Based on the described embodiments of the present disclosure, various other embodiments can be obtained by those of ordinary skill in the art without creative labor and those embodiments shall fall into the scope of the present disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present application, are not intended to indicate any sequence, amount or importance, but for distinguishing various components. Also, the terms, such as "comprise/comprising," "include/including," or the like are intended to specify that the elements or the objects stated before these terms encompass the elements or the objects and equivalents thereof listed after these terms, but not preclude other elements or objects. The terms, "on," "under," or the like are only used to indicate relative position relationship, and when the position of the object which is described is changed, the relative position relationship may be changed accordingly.

It has been noticed by inventors that, for most of display devices having an anti-peep function, they replace a visible-light backlight source with a non-visible-light backlight source, and users need to wear a special optical equipment to see display pictures, to prevent being peeped by others. However, owing to technical constraints of related optical equipments, a non-visible light in a fixed waveband or a non-visible light with a single wavelength is normally used as a backlight source for non-visible-light backlight sources, accordingly, the non-visible light emitted from the display device is also a non-visible light in a fixed waveband or a non-visible light with a single wavelength. As such, cracking can be accomplished by measuring the wavelength of a non-visible light emitted from the display device at any moment. This encrypting mode is too simple to be cracked easily.

Embodiment 1

Figure 1:
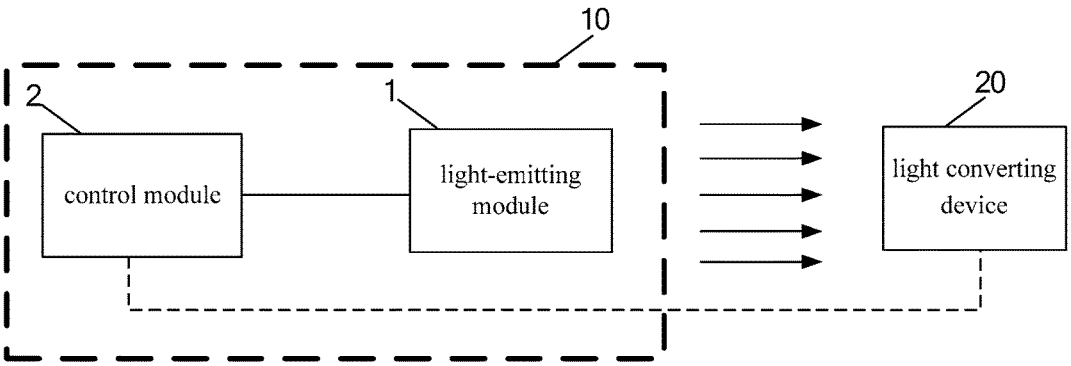
FIG. 1 is a schematic structural view illustrating a display system provided by an embodiment of the present disclosure.

According to an embodiment of the present disclosure, a display device is provided. Referring to FIG. 1, the display device 10 includes: a light-emitting module 1, which can emit at least two non-visible lights, among them, the wavelengths of non-visible lights of different types are different; a control module 2 used for controlling the light-emitting module 1 to alternately emit at least two non-visible lights at a wavelength adjusted timing, and for sending a synchronous signal used for reflecting the wavelength adjusted timing to a light converting device 20.

The non-visible lights of such a type that are emitted at different moments with a same wavelength are called as non-visible lights of one type in embodiments of the present disclosure. Exemplarily, a light-emitting module emits non-visible lights L1, L2 and L3 at times t1, t2 and t3, respectively, if wavelengths of L1, L2 and L3 are all the same, L1, L2 and L3 belong to one kind or one type of non-visible lights.

In addition, in embodiments of the present invention, exemplarily, non-visible lights of one kind may only include electromagnetic waves with a same wavelength (e.g., electromagnetic waves with a wavelength of about 0.8 μm); and they may be electromagnetic waves in a waveband (e.g., electromagnetic waves in the range of about 0.2 μm to about 0.3 μm). But, embodiments of the present disclosure are not limited thereto, and wavelength or wavelength range of non-visible lights may also be other value or range. As can be seen from the spectrogram, wavelength of visible lights is in the range of 0.38 to 0.78 μm, and light waves with wavelengths outside this range are all non-visible lights, such as infrared lights with wavelengths in the range of 0.78 to 1000 μm, and ultraviolet light with wavelengths in the range of 0.2 to 0.38 μm. Since non-visible lights in other wavelength ranges may cause greater damage to the human body, wavelength of the above non-visible lights may be set to be within the wavelength range of infrared lights or ultraviolet lights.

The wavelengths of non-visible lights of different types being different means that, wavelengths of non-visible lights of different types are completely different, or, wavelengths of non-visible lights of different types are partially different. For example, non-visible lights of the first kind include all of electromagnetic waves within the range of 5 to 10 μm, non-visible lights of the second kind includes all of electromagnetic waves within the range of 20 to 30 μm, then wavelengths of the non-visible lights of the first kind and the non-visible lights of the second kind are completely different, which belongs to the former. For another example, non-visible lights of the first kind include all of electromagnetic waves within the range of 5 to 10 μm, non-visible lights of the second kind includes all of electromagnetic waves within the range of 8 to 30 μm, and wavelengths of the non-visible lights of the first kind and the non-visible lights of the second kind are partially different, which belongs to the latter.

The wavelength adjusted timing refers to a corresponding relationship between emission time and emission wavelength of non-visible lights. Descriptions will be given with reference to an example in which a display device alternately gives off two non-visible lights. For example, a non-visible light is emitted from the display device at time t1, another non-visible light is emitted at time t2, and they take turns in this way. What the wavelength adjusted timing reflects is which non-visible light is given off correspondingly by a display device at each time. The synchronous signal may include a wavelength adjusted timing, and may further include wavelength information at the current time, and it can be determined by the number of types of non-visible lights emitted from the display device alternately. For example, if a display device gives off two non-visible lights by turn, the synchronous signal may only include a wavelength adjusted timing, and a light converting device may choose one wavelength converting unit based on the wavelength adjusted timing to convert a non-visible light into a visible light; if a display device gives off three non-visible lights by turn, the synchronous signal may include a wavelength adjusted timing and the current wavelength information, and a light converting device may choose a corresponding wavelength converting unit based on the wavelength adjusted timing and the current wavelength information to convert a non-visible light into a visible light.

For example, a material for emitting a non-visible light may be used to directly produce a non-visible light, or a visible light is used to be converted into a non-visible light by a wavelength converting device. But, embodiments of the present disclosure are not limited thereto.

For example, the display device may emit two non-visible lights alternately, it may also emit three non-visible lights alternately, but the embodiments of the present disclosure are not limited thereto. The larger the number of types of non-visible lights emitted by a display device alternately is, the higher the encrypting property of the display device is, and the more complex the structure of the display device and a light converting device are. In consideration of these conditions, it may select two non-visible lights are to be emitted by a display device alternately, so as to balance the above relationships. Embodiments of the present disclosure and drawings are each described or shown with reference to an example in which a display device gives off two non-visible lights alternately, but embodiments of the present disclosure are not limited thereto, as always.

In the display device, the control module may be a circuit component integrated in a single chip microcomputer, a Field Programmable Gate Array or other chip, or it may be a separate circuit structure. But, embodiments of the present disclosure are not limited thereto, for example, the circuit structure of the control module may take other forms which can meet the above function.

In embodiments of the present disclosure, the display device may be a liquid crystal display device, or it may be an Organic Light-Emitting Diode (OLED) display device. But, embodiments of the present disclosure are not limited thereto, for example, it may be a display device in other form.

With respect to the display device provided by embodiments of the present disclosure, with aid of a control module, the display device allows a light-emitting module to emit at least two non-visible lights alternately at a wavelength adjusted timing, and send a synchronous signal to a light converting device. In this way, wavelength of non-visible lights emitted by the display device varies continually in accordance with the wavelength adjusted timing, and non-visible lights of different types are emitted at different times. Thus, it is impossible to determine a situation at other moment by acquisition of only the wavelength of a non-visible light at one certain moment. This encrypting mode is relatively complex, and it is not easy to be cracked.

The source of non-visible lights emitted from the above light-emitting module will be explained below by two ways.

First Way: the light-emitting module includes at least two non-visible light sources, among which, non-visible lights that can be emitted by non-visible light sources of different types have different wavelengths. The control module is used to control the at least two non-visible light sources to emit light alternately at a wavelength adjusted timing.

It is noted that wavelengths of non-visible lights produced by the non-visible light sources and the number of non-visible light sources in embodiments of the present disclosure are not limited to the embodiments already provided herein, and there may also be other situations.

Non-visible lights can be produced directly in this manner, and it is relatively simple to implement.

For example, the light-emitting module includes a first non-visible light source and a second non-visible light source; the control module is used to control the first non-visible light source and the second non-visible light source to emit two non-visible lights alternately at a wavelength adjusted timing. In this way, the cost can be reduced, and it is easy to implement.

For example, the first non-visible light source is an infrared light source, and the second non-visible light source is an ultraviolet light source. In this way, non-visible lights in other wavebands, such as, X rays, α rays or the like, can be avoided from causing damage to the human body, meanwhile, the encrypting property is enhanced.

Second Way: The light-emitting module includes a visible light source; a wavelength converting unit used for converting a visible light emitted from the visible light source into a non-visible light; and a control module used for controlling the wavelength converting unit alternately to convert a visible light into at least two non-visible lights at a wavelength adjusted timing.

In this way, a visible light is converted into a non-visible light by a wavelength converting unit, and conversion of a visible light into non-visible lights in different wavebands can be achieved by choosing different wavelength converting units. It is relatively flexible in use.

The wavelength converting unit in embodiments of the present disclosure may be a photo-electric device having a wavelength conversion function that is achieved with the photo-electric conversion technology. Optionally, the wavelength converting unit may be a nonlinear crystal or a semiconductor optical amplifier. The semiconductor optical amplifier (SOA) includes wavelength converter of a cross-gain saturation modulation (XGM SOA) type, a cross-phase modulation (XPM SOA) type and a four-wave mixing (FWM) type, but embodiments of the present disclosure are not limited thereto.

Embodiment 2

Figure 2:
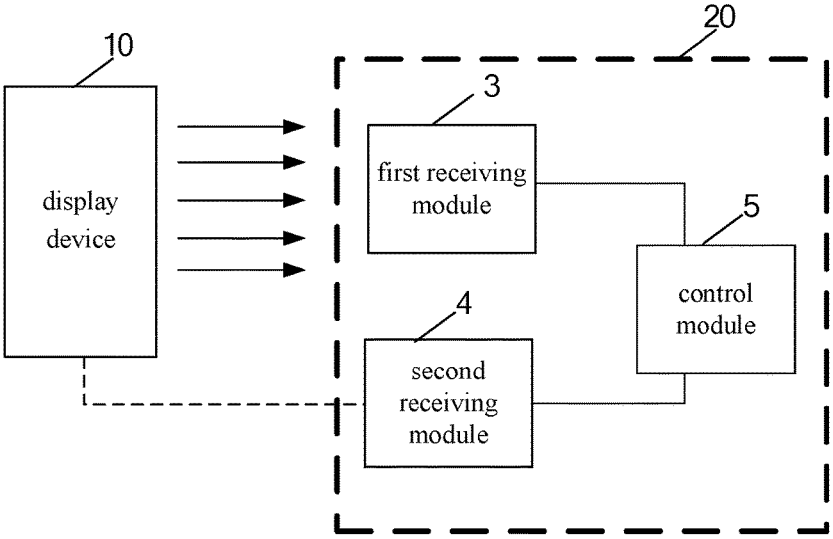
FIG. 2 is a schematic structural view illustrating another display system provided by an embodiment of the present disclosure.

According to an embodiment of the present disclosure, a light converting device is provided. Referring to FIG. 2, the light converting device includes a first receiving module 3 used for receiving at least two non-visible lights emitted by the display device alternately; a second receiving module 4 used for receiving a synchronous signal emitted by the display device, the synchronous signal being used for reflecting a wavelength adjusted timing of the display device; and a control module 5 used for converting the at least two non-visible lights into visible lights synchronously at the wavelength adjusted timing according to the synchronous signal, and for outputting the visible lights.

It is noted that meanings of the at least two non-visible lights and the wavelength adjusted timing are the same as those in Embodiment 1, and details are omitted herein. With respect to the light converting device provided by embodiments of the present disclosure, by the first receiving module, the second receiving module and the control module, it is possible to convert at least two non-visible lights emitted from the display device into visible lights synchronously, and to output the visible lights.

Figure 3:
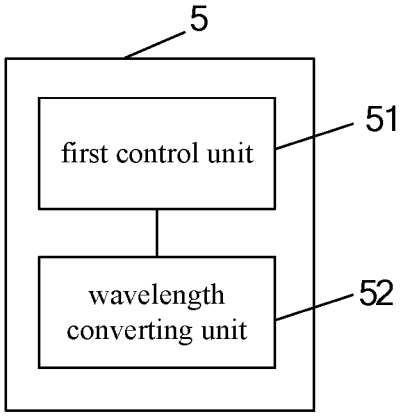
FIG. 3 is a schematic structural view illustrating a structure of a control module of a light converting device in FIG. 2.

Optionally, referring to FIG. 3, the above control module 5 includes: a first control unit 51 used for transmitting a non-visible light received at the current time in the wavelength adjusted timing, based on (or in response to) the synchronous signal, to a wavelength converting unit 52 by an input optical path corresponding to the non-visible light, non-visible lights of different types corresponding to different input optical paths; and at least two wavelength converting units 52, each of which is used to convert a non-visible light into a visible light.

It is noted here that an input optical path by which a received non-visible light is transmitted to a wavelength converting unit in embodiments of the present disclosure may be determined in the light of the actual circumstances. In addition, the number of wavelength converting units included in the control module according to embodiments of the present disclosure may be determined according to the type of received non-visible lights, but embodiments of the present disclosure are not limited thereto. For example, if a control module receives two non-visible lights, the control module may include two wavelength converting units; if a control module receives three non-visible lights, the control module may include three wavelength converting units. But, embodiments of the present disclosure are not limited thereto.

It is noted that the first control unit in embodiments of the present disclosure may be a separate optical element, such as a mirror, and this structure is easy to realize and easy to manufacture. But, embodiments of the present disclosure are not limited there. For example, the first control unit may have other structure.

Figure 4:
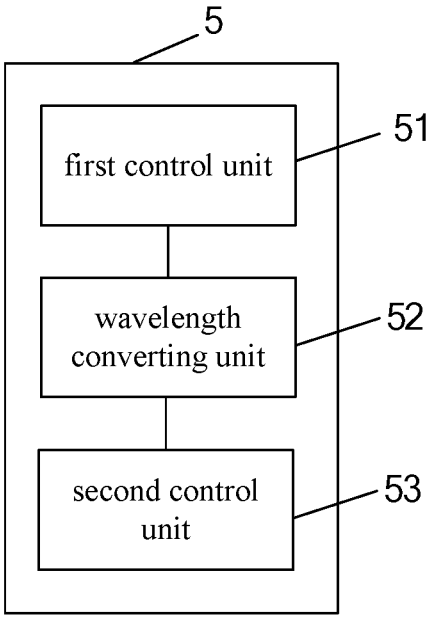
FIG. 4 is a schematic structural view illustrating another structure of the control module of the light converting device in FIG. 2.

Optionally, referring to FIG. 4, the above control module 5 may further include: a second control unit 53 used for outputting a visible light emitted from a wavelength converting unit, based on a synchronous signal, by an output optical path corresponding to the visible light. Visible lights that are obtained by converting non-visible lights of different types correspond to different output light paths.

An output optical path of a visible light emitted by a wavelength converting unit in embodiments of the present disclosure may be that the visible light is directly output from the wavelength converting unit, and may also be that it is output by a second control unit, but, embodiments of the present disclosure are not limited thereto. For example, the above structure can be designed more flexibly by controlling an output optical path of a visible light with aid of a second control unit, so as to facilitate manufacture and the user experience.

Figure 5:
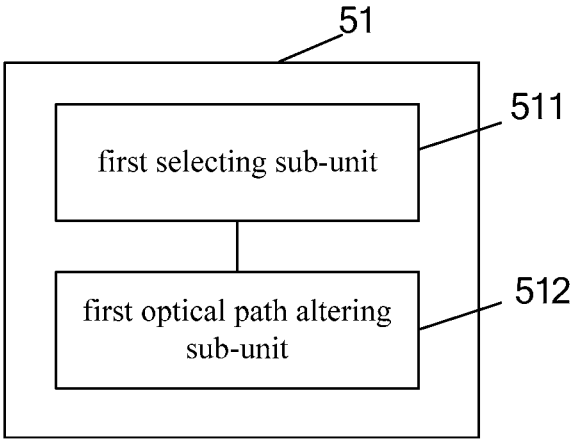
FIG. 5 is a schematic structural view illustrating a first control unit in FIG. 2.

Optionally, referring to FIG. 5, the first control unit 51 includes a first selecting sub-unit 511 used for transmitting a non-visible light received at the current time in a wavelength adjusted timing, based on a synchronous signal, to a first optical path altering sub-unit 512; and the first optical path altering sub-unit 512 is used for receiving a non-visible light emitted from the first selecting sub-unit 511 and transmitting the non-visible light to a wavelength converting unit 52.

It is noted herein that each of the first selecting sub-unit and the first optical path altering sub-unit in embodiments of the present disclosure may be a mirror, but embodiments of the present disclosure are not limited thereto.

Figure 6:
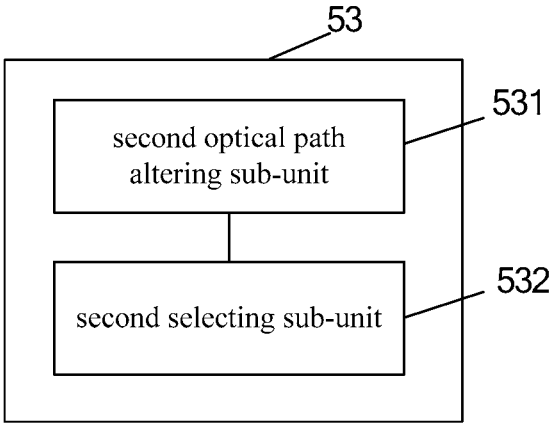
FIG. 6 is a schematic structural view illustrating a second control unit in FIG. 2.

Optionally, referring to FIG. 6, the second control unit 53 includes a second optical path altering sub-unit 531 used for outputting a visible light emitted from the wavelength converting unit 52 to a second selecting sub-unit 532; and the second selecting sub-unit 532 is used for outputting, based on a synchronous signal, a visible light emitted from the second optical path altering sub-unit 531.

It is noted herein that each of the second selecting sub-unit and the second optical path altering sub-unit in embodiments of the present disclosure may be a mirror, but embodiments of the present disclosure are not limited thereto.

For example, the light converting device may be a pair of glasses for user's wearing.

Hereinafter, for example, with reference to a light converting device shown in FIG. 7*a* and FIG. 7*b*, how to convert the received two non-visible lights into visible lights by the light converting device and how to output them will be described in detail. Embodiments of the present disclosure will be described only with reference to an example in which two non-visible lights are received, but embodiments of the present disclosure are not limited thereto.

Figure 7A:
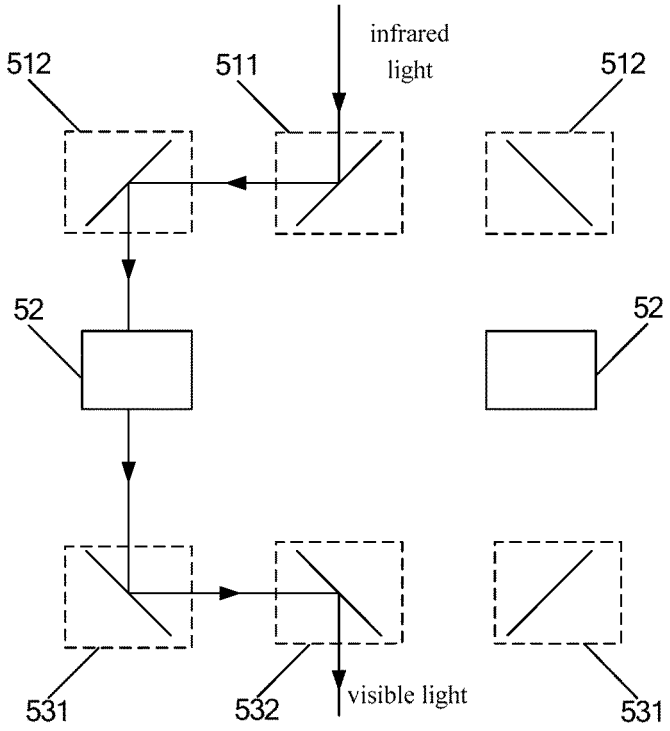
FIG. 7*a* is a schematic view illustrating the optical path for conversion of an infrared light received by a light converting device at the current time in a wavelength adjusted timing into a visible light.
Figure 8A:
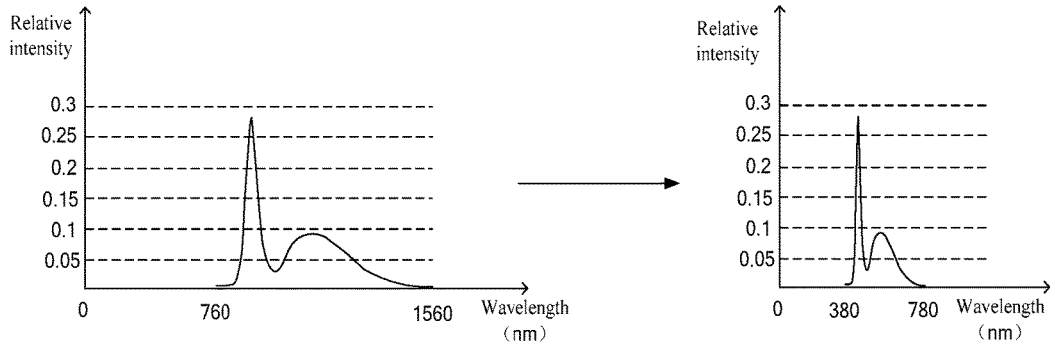
FIG. 8*a* shows a spectrogram of an infrared light received by a light converting device and a spectrogram of a visible light converted from the infrared light.

Referring to FIG. 7*a*, with a first selecting sub-unit 511 and based on a synchronous signal, an infrared light (as shown in FIG. 8*a*) received at the current time in a wavelength adjusted timing is reflected to a first optical path altering sub-unit 512, then, it enters a wavelength converting unit 52 with aid of the reflection of the first optical path altering sub-unit 512. The wavelength converting unit 52 herein can convert an infrared light shown in FIG. 8*a* into a visible light shown in FIG. 8*a*, next, a visible light emitted from the wavelength converting unit 52 is reflected by a second optical path altering sub-unit 531 to a second selecting sub-unit 532, with the second selecting sub-unit 532 and based on a synchronous signal, the visible light emitted from the second optical path altering sub-unit 531 is output. It is noted herein that each of the first selecting sub-unit 511 and the second selecting sub-unit 532 can synchronously adjust the angle of the mirror according to a synchronous signal, so that the light is transmitted in accordance with the optical path shown in FIG. 7*a*.

Figure 7B:
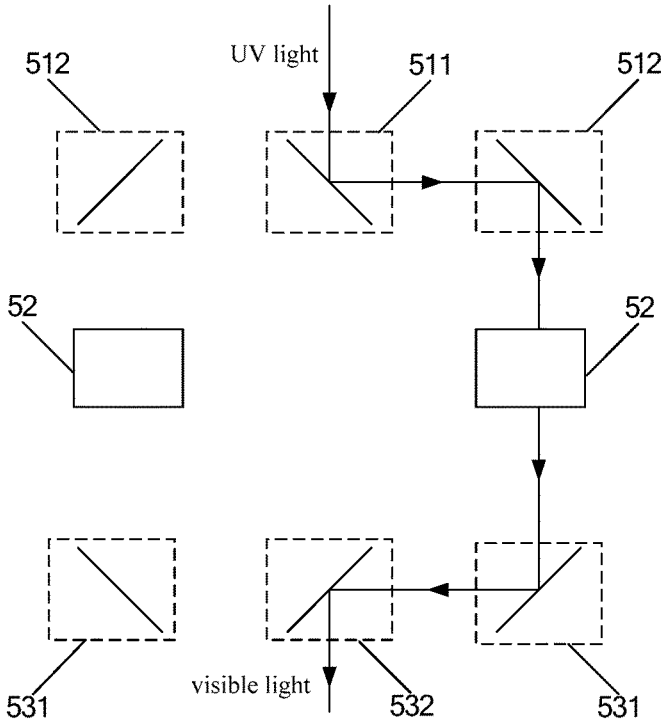
FIG. 7*b* is a schematic view illustrating the optical path for conversion of an ultraviolet light received by a light converting device at the next time in a wavelength adjusted timing into a visible light.
Figure 8B:
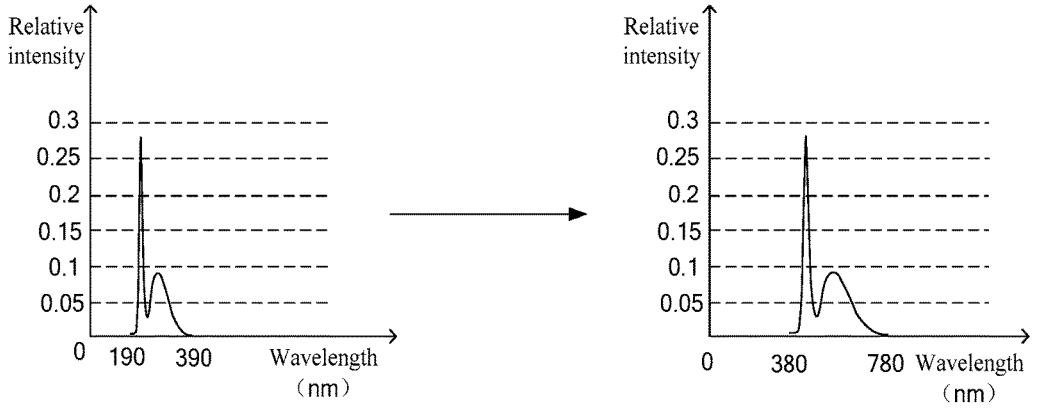
FIG. 8*b* shows a spectrogram of an ultraviolet light received by a light converting device and a spectrogram of a visible light converted from the ultraviolet light.

Referring to FIG. 7*b*, with a first selecting sub-unit 511 and based on a synchronous signal, an ultraviolet light (as shown in FIG. 8*b*) received at the next time in a wavelength adjusted timing is reflected to a first optical path altering sub-unit 512, then, it enters a wavelength converting unit 52 with aid of the reflection of the first optical path altering sub-unit 512. The wavelength converting unit 52 herein can convert an ultraviolet (UV) light shown in FIG. 8*b* into a visible light shown in FIG. 8*b*, next, a visible light emitted from the wavelength converting unit 52 is reflected by a second optical path altering sub-unit 531 to a second selecting sub-unit 532, with the second selecting sub-unit 532 and based on a synchronous signal, the visible light emitted from the second optical path altering sub-unit 531 is output. It is noted herein that each of the first selecting sub-unit 511 and the second selecting sub-unit 532 can synchronously adjust the angle of the mirror according to a synchronous signal, so that the light is transmitted in accordance with the optical path shown in FIG. 7*b*.

According to embodiments of the present disclosure, a light converting device is provided, which is configured to synchronously convert at least two non-visible lights emitted from the display device into visible lights and outputting them by a first receiving module, a second receiving module and a control module.

Embodiment 3

According to an embodiment of the present disclosure, a display system is provided, which includes the display device provided by Embodiment 1 and the light converting device provided by Embodiment 2. This display system is improved in encryption so as to avoid being peeped and/or being cracked easily.

The described above are only illustrative implementations of the present disclosure, and the present disclosure is not intended to limited thereto. For a person of ordinary skill in the art, various modifications and improvements can be made without departing from the spirit and scope of the present disclosure, and all of which shall fall within the scope of the present disclosure.

This application claims the benefit of priority of Chinese patent application No. 201510629710.5 filed on Sep. 28, 2015 and entitled "a display device, light converting device and display system," and the disclosure of which is incorporated herein in its entirety by reference.

What is claimed is:

1. An anti-peep display device, comprising:

a light-emitting module configured to emit at least two non-visible lights, non-visible lights of different types among which having different wavelengths; and a first control module configured to control the light-emitting module to alternately emit the at least two non-visible lights at a wavelength adjusted timing, and to send a synchronous signal to a light converting device, wherein the light converting device comprises a second control module, the second control module comprising a first control unit with a first selecting sub-unit, a wavelength converting unit, and a second control unit with a second selecting sub-unit, the first selecting sub-unit and the second selecting sub-unit synchronously adjusting angles of mirrors in a first optical path and a second optical path, respectively, wherein the light-emitting module comprises:

a visible light source; and a second wavelength converting unit configured to convert a visible light emitted from the visible light source into a non-visible light, wherein the first control module is configured to control the second wavelength converting unit to alternately convert the visible light into at least two non-visible lights at a wavelength adjusted timing.

2. The display device according to claim 1, wherein the second wavelength converting unit is a nonlinear crystal or a semiconductor optical amplifier.

3. A light converting device, comprising:

a first receiving module configured to receive at least two non-visible lights emitted alternately by a display device;

a second receiving module configured to receive a synchronous signal sent by the display device, the synchronous signal including a wavelength adjusted timing and wavelength information; and a control module comprising a first control unit, at least two wavelength converting units, each of which is configured to convert one non-visible light into a visible light, and a second control unit configured to synchronously convert, based on the synchronous signal, the at least two non-visible lights into visible lights at the wavelength adjusted timing and to output the visible lights, wherein the first control unit includes a first selecting sub-unit, and the second control unit includes a second selecting sub-unit, the first selecting sub-unit and the second selecting sub-unit synchronously adjusting angles of mirrors in a first optical path and second optical path, respectively.

4. The device according to claim 3, wherein the first control unit further comprises a first optical path altering sub-unit, and is configured to transmit, based on the synchronous signal, a non-visible light received at the current time in the wavelength adjusted timing to a first wavelength converting unit by an input optical path corresponding to the non-visible light, non-visible lights of different types corresponding to different input optical paths.

5. The device according to claim 4, wherein the second control unit further comprises a second optical path altering sub-unit, and is configured to output, based on the synchronous signal, the visible light emitted from the wavelength converting unit by an output optical path corresponding to the visible light, visible lights obtained by converting non-visible lights of different types corresponding to different output optical paths.

6. The device according to claim 4, wherein the first selecting sub-unit is configured to transmit, based on the synchronous signal, a first non-visible light received at the current time in the wavelength adjusted timing to the first optical path altering sub-unit, the first optical path altering sub-unit being configured to receive the first non-visible light emitted from the first selecting sub-unit and to transmit the non-visible light to a wavelength converting unit.

7. The device according to claim 5, wherein each of the first optical path altering sub-unit and the second optical path altering sub-unit is a mirror.

8. The device according to claim 5, wherein the second optical path altering sub-unit is configured to output a visible light emitted from the wavelength converting unit to a second selecting sub-unit; and the second selecting sub-unit is configured to output, based on the synchronous signal, a visible light emitted from the second optical path altering sub-unit.

9. The device according to claim 3, wherein the light converting device is a pair of glasses.

10. An anti-peep display system, comprising a display device and a light converting device;

wherein the display device includes a light-emitting module configured to emit at least two non-visible lights, non-visible lights of different types having different wavelengths, and a first control module configured to control the light-emitting module to alternately emit the at least two non-visible lights at a wavelength adjusted timing, and to send a synchronous signal to the light converting device; and wherein the light converting device includes a first receiving module configured to receive at least two non-visible lights emitted alternately by a display device, a second receiving module configured to receive a synchronous signal sent by the display device, and a second control module comprising a first control unit, at least two wavelength converting units, each of which being configured to convert one non-visible light into a visible light, and a second control unit and being configured to synchronously convert, based on the synchronous signal, the at least two non-visible lights into visible lights at the wavelength adjusted timing, and to output the visible lights, wherein the first control unit includes a first selecting sub-unit, and the second control unit includes a second selecting sub-unit, the first selecting sub-unit and the second selecting sub-unit synchronously adjusting angles of mirrors in a first optical path and second optical path, respectively.

11. The display system according to claim 10, wherein the light-emitting module comprises at least two non-visible light sources, non-visible lights that can be emitted from the non-visible light sources of different types having different wavelengths, wherein the first control module is configured to control the at least two non-visible light sources to emit light alternately at a wavelength adjusted timing.

12. The display system according to claim 11, wherein the light-emitting module comprises a first non-visible light source and a second non-visible light source, wherein the first control module is configured to control the first non-visible light source and the second non-visible light source to emit two non-visible lights alternately at a wavelength adjusted timing.

13. The display system according to claim 10, wherein the light-emitting module comprises:

a visible light source; and a second wavelength converting unit configured to convert a visible light emitted from the visible light source into a non-visible light, wherein the first control module is configured to control the second wavelength converting unit to alternately convert the visible light into at least two non-visible lights at a wavelength adjusted timing.

14. The display system according to claim 10, wherein the first control unit is configured to transmit, based on the synchronous signal, a non-visible light received at the current time in the wavelength adjusted timing to a wavelength converting unit by an input optical path corresponding to the non-visible light, non-visible lights of different types corresponding to different input optical paths.

15. The display system according to claim 14, wherein the second control unit is configured to output, based on the synchronous signal, the visible light emitted from the wavelength converting unit by an output optical path corresponding to the visible light, visible lights that is obtained by converting non-visible lights of different types corresponding to different output optical paths.

16. The display system according to claim 10, wherein the first selecting sub-unit is configured to transmit, based on the synchronous signal, a first non-visible light received at the current time in the wavelength adjusted timing to the first optical path altering sub-unit, the first optical path altering sub-unit being configured to receive the first non-visible light emitted from the first selecting sub-unit and to transmit the first non-visible light to a wavelength converting unit;

the second optical path altering sub-unit is configured to output a visible light emitted from the wavelength converting unit to a second selecting sub-unit; and the second selecting sub-unit is configured to output, based on the synchronous signal, a visible light emitted from the second optical path altering sub-unit.

* * * * *